US009878363B2

(12) United States Patent
Meneghetti

(10) Patent No.: US 9,878,363 B2
(45) Date of Patent: Jan. 30, 2018

(54) PUNCHING APPARATUS

(71) Applicant: SALVAGNINI ITALIA S.P.A., Sarego (IT)

(72) Inventor: Nicola Meneghetti, Villaga (IT)

(73) Assignee: SALVAGNINI ITALIA S.P.A., Sarego (Vi) (IT)

( * ) Notice: Subject to any disclaimer, the term of this patent is extended or adjusted under 35 U.S.C. 154(b) by 0 days.

(21) Appl. No.: 15/328,640

(22) PCT Filed: Jul. 28, 2015

(86) PCT No.: PCT/IB2015/055694

§ 371 (c)(1),
(2) Date: Jan. 24, 2017

(87) PCT Pub. No.: WO2016/016807

PCT Pub. Date: Feb. 4, 2016

(65) Prior Publication Data

US 2017/0209912 A1 Jul. 27, 2017

(30) Foreign Application Priority Data

Jul. 29, 2014 (IT) ..... BO2014A0429

(51) Int. Cl.
*B21D 28/12* (2006.01)
*B21D 28/24* (2006.01)

(52) U.S. Cl.
CPC ..... *B21D 28/125* (2013.01); *B21D 28/246* (2013.01)

(58) Field of Classification Search
CPC ..... B21D 28/12; B21D 28/125; B21D 28/246
See application file for complete search history.

(56) References Cited

U.S. PATENT DOCUMENTS

| | | | | |
|---|---|---|---|---|
| 5,012,712 | A | 5/1991 | Nordquist | |
| 6,074,330 | A | 6/2000 | Ostini | |
| 2011/0107888 | A1* | 5/2011 | Thielges | B21D 28/005 83/139 |

FOREIGN PATENT DOCUMENTS

| | | |
|---|---|---|
| DE | 39 12 871 | 11/1989 |
| EP | 0 875 310 | 11/1998 |

(Continued)

OTHER PUBLICATIONS

International Search Report dated Nov. 5, 2015 in International (PCT) Application No. PCT/IB2015/055694.

(Continued)

*Primary Examiner* — Debra Sullivan
(74) *Attorney, Agent, or Firm* — Wenderoth, Lind & Ponack, L.L.P.

(57) ABSTRACT

A punching apparatus includes a tool holder unit rotatable around a working axis and provided with a plurality of seats for slidably housing respective punching tools, a beating element movable along and around the working axis and provided with an operating end that has a beating portion to selectively interact with a set punching tool, a first driving assembly for moving the beating element along the working axis to move the set punching tool, and a second driving assembly for rotating the tool holder unit around the working axis. The operating end of the beating element includes a first coupling element and the tool holder unit includes a plurality of second coupling elements, each of the second coupling elements being associated with a respective one of the seats and a related one of the punching tools and being arranged to couple with the first coupling element in a connection configuration.

15 Claims, 5 Drawing Sheets

(56) References Cited

FOREIGN PATENT DOCUMENTS

| | | |
|---|---|---|
| EP | 1 445 042 | 8/2004 |
| EP | 1 634 663 | 3/2006 |
| WO | 2014/191877 | 12/2014 |

OTHER PUBLICATIONS

Written Opinion of the International Searching Authority dated Nov. 5, 2015 in International (PCT) Application No. PCT/IB2015/055694.

* cited by examiner

PUNCHING APPARATUS

The invention relates to machine tools for the machining of workpieces and/or metal sheets and in particular the invention relates to a punching apparatus associable with a punching machine for carrying out cuttings and/or punchings.

The known punching machines are provided with a punching apparatus, referred to as punching head, which supports and moves along a working axis a punching tool, which acts on the workpiece, typically a sheet metal, cooperating with a below punching die or counter-punch. Usually the die is fixed to a worktable of the punching machine that supports the workpiece to be machined.

In the punching heads with single tool the latter is mounted on a supporting element, so-called mandrel, which is driven linearly along and in rotation around the working axis by respective actuators. The linear movement along the working axis in the two opposite directions allows performing the working stroke and the back stroke of the tool in the punching process. The movement of rotation around the working axis allows to rotate the punching tool and to change the angular orientation (indexing) thereof for carrying out different cuttings or punchings on the workpiece.

Two separate actuators, of hydraulic or electric type, are used for moving, respectively linearly and in rotation, the mandrel that supports the tool.

The multi-tool punching heads comprise a beating element, so called ram, which is moved linearly along the working axis and acts on the selected tool by imparting to the latter, the kinetic energy and the linear motion that is needed for performing the machining on the workpiece.

The punching tools are housed in a tool holder device that is fixed to the punching head and arranged between the ram and the workpiece. The tool holder device generally comprises a rotatable drum in which the tools are slidably housed that are circumferentially arranged around the rotation axis of the drum itself.

In the multi-tool punching heads, so-called fixed head, the ram is linearly moved along the working axis for driving the tool and can be rotated around said working axis for selecting and driving a specific tool among the different tools which are housed in the tool holder device.

The rotation of the punching tool around a respective axis for the angular orientation (indexing) is carried out by rotating in a coordinated manner the tool holder device and the ram.

Two separate actuators are required for driving linearly and rotatably the ram and a third actuator is provided for rotating the tool holder device and performing the angular orientation of the tool.

In the multi-tool punching heads so-called rotating punching head, the ram can only move linearly and the selection of the tool and the angular orientation thereof are carried out by rotating in a coordinated manner a head portion and the tool holder device. More precisely, the selection of the tool to be driven is carried out by rotating an upper portion of the head (which contains the beating means of the tools) with respect to a below lower portion that houses the tools. The angular orientation (indexing) is carried out by overall rotating the whole punching head (upper and lower portions) around the working axis.

Alternatively, in order to select tool the lower portion of the punching head can be rotated by keeping blocked the upper portion by blocking means (for example a pneumatic bolt).

In both cases, in addition to the actuator which is necessary for linearly moving the ram, two actuators are necessary for rotating the two portions of the punching head or for rotating the lower portion and blocking the upper portion.

So-called multiple punching heads are known that comprise a plurality of tool holder devices and respective rams which are arranged along one or more parallel rows for performing multiple machining operations on the same workpiece or more sequential machining operations without the need for replacing the tools, but simply by moving the workpiece and positioning the latter under the appropriate ram. Also in this case, for each ram and respective tool holder device, three actuators are required for linearly moving the ram and for selecting and angularly orientating the punching tool.

A drawback of the known multi-tool punching apparatuses, with fixed or rotating head, with single tool-holder device or with multiple tool holder devices (multiple punching heads), lies in the fact that they require three separate actuators for moving the ram and selecting and angularly orienting the punching tool. The three actuators and the respective motion transmission means, which are generally complex, involve relevant dimensions and high costs.

An object of the present invention is to improve the known punching apparatuses, in particular the multi-tool punching apparatuses, with single tool holder unit or multiple tool holder units.

Another object is to provide a punching apparatus having a simple and compact structure and small dimensions.

A further object is to carry out a punching apparatus that allows to optimally perform the punching process and at the same time allows to select and angularly orient the punching tool by using a limited number of actuators.

These and other objects are achieved by a punching apparatus according to any of the below disclosed claims.

The invention can be better understood and implemented with reference to the attached drawings that illustrate some exemplifying and not limitative embodiments of the invention, wherein.

Figure 1:
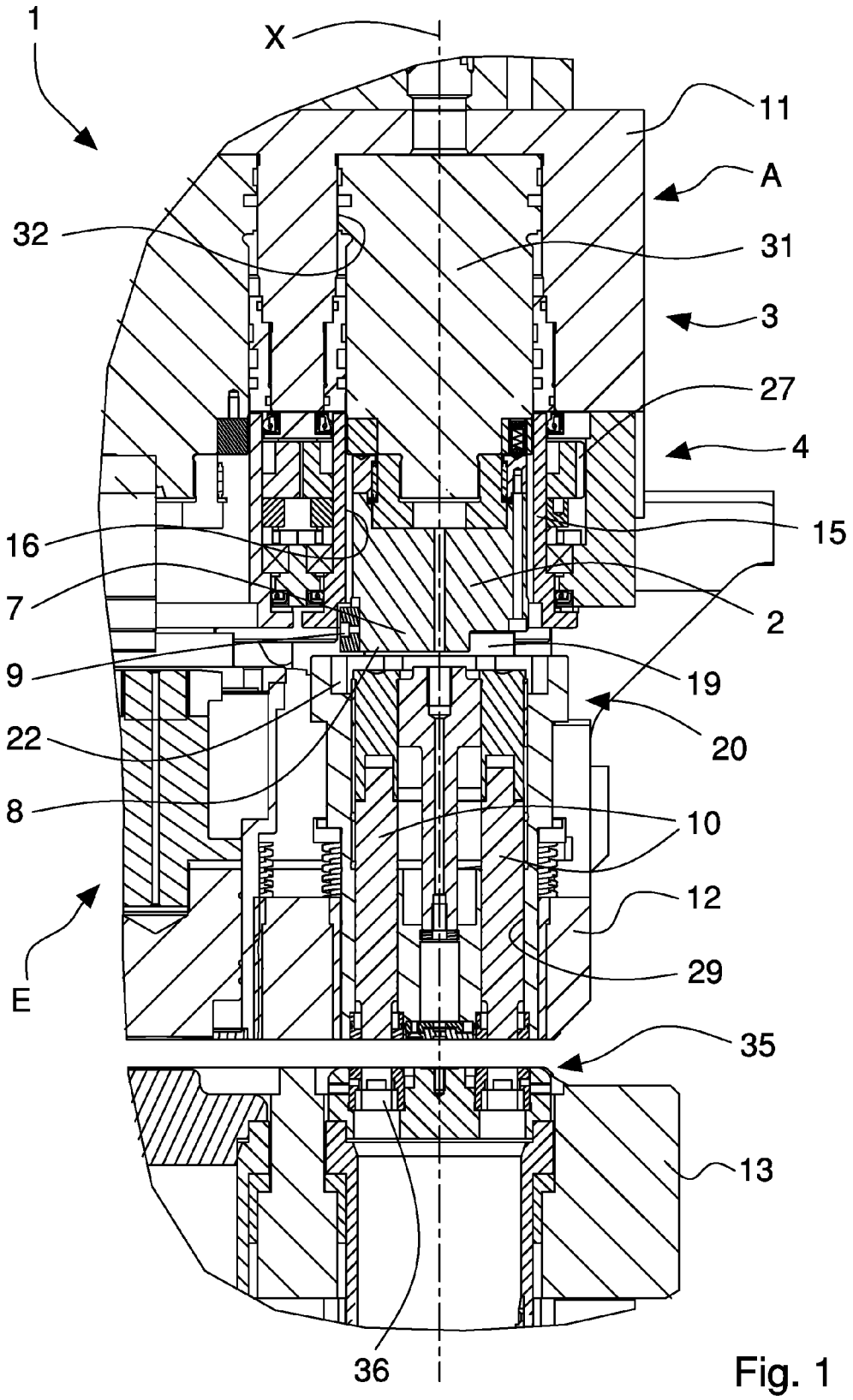
FIG. 1 is a longitudinal section of the punching apparatus of the invention wherein a beating element is in an internal operating position.

With reference to FIGS. 1 to 6, a punching apparatus 1 according to the invention is illustrated that is associable to a punching tool machine, of known type and not illustrated, which is arranged to perform cuttings and/or punchings on workpieces, in particular sheet metal.

The punching apparatus 1, conventionally also referred to as punching head, comprises a tool holder 20, which is provided with a plurality of punching tools 10, a beating element 2, so-called ram, which is suitable to interact and selectively drive a set punching tool 10, so-called punch, first driving means 3 for moving said beating element 2 and second driving means 4 for moving the tool holder unit 20.

The tool holder unit 20 substantially comprises a drum, which is rotatable around a working axis X, and is provided with a plurality of seats 21, which are suitable to slidably house respective punching tools 10. The beating element 2 comprises a cylindrical element, that is movable along, and around, the working axis X and is provided with an operating end 7 having a beating portion 8 that is arranged to selectively interact with a set punching tool 10. More precisely, the beating portion 8 is shaped so as to abut only a set punching tool 10 and push the latter against the workpiece.

The first driving means 3 is arranged to move the beating element 2 along the working axis X so as to move and push the set punching tool 10 against the workpiece. More precisely, the first driving means 3 moves the beating element 2 between an internal operating position A, in which said beating element 2 is more spaced from the tool holder 20 and the punching tool 10, an intermediate operating position B, in which said beating element 2 is engaged and connected to the tool holder unit 20, and an external operating position C, in which the beating element 2 is engaged by the tool holder unit 20 and abuts and pushes the punching tool 10 against the workpiece.

The second driving means 4 is arranged to rotate the tool holder unit 20 around the working axis X.

The operating end 7 of the beating element 2 comprises a first coupling element 9, while the tool holder unit 20 comprises a plurality of second coupling elements 22, each of which is associated to a respective seat 21 and arranged to couple with the first coupling element 9 in a connection configuration F, in which the beating element 2 and the tool holder unit 20 are coupled so as to integrally rotate.

As better explained in the following description, the second driving means 4 in a selection configuration E (in which the beating element 2 and the tool holder unit 20 are separate and uncoupled) rotates the tool holder unit 20 for positioning a set punching tool 10 so that the latter faces the beating portion 8 of the operating end 7 of the beating element 2 so as to allow the first coupling element 9 to couple with the second coupling element 22 that is associated with the seat 21 of the set punching tool 10, when subsequently the beating element 2 and the tool holder unit 20 are arranged in the connection configuration F. In said connection configuration F, the second driving means 4 rotates the tool holder unit 20 and the beating element 2, which are mutually connected, so as to angularly orient the set punching tool 10.

The punching apparatus 1 comprises an upper supporting element 11, which is arranged to house the first driving means 3 and the beating element 2, and a lower supporting element 12, which is arranged to slidably and rotatably house the tool holder unit 20.

In the embodiment that is illustrated in the figures, the tool holder unit 20 comprises six seats 21 that house respective punching tools 10 and are arranged angularly equidistant from each other around a longitudinal axis of the tool holder unit 20, which substantially coincides with the working axis X.

The first coupling element comprises a projecting element 9, for example a tab, which is fixed on an external wall of the beating element 2, in particular of the operating end 7, and the second coupling elements comprise respective grooves or notches 22 that are carried out on an internal cylindrical wall of a housing 24 of the tool holder unit 20 that is suitable to receive at least partially the operating end 7 of the beating element 2 in the connection configuration F.

In the illustrated embodiment, the tab 9 is radially fixed to a cylindrical external wall of the beating element 2 and is capable to enter and selectively engage a set groove 22. The tab 9 and the grooves 22 have a substantially complementary shape.

Alternatively, the first coupling element may comprise a radial projection that is directly carried out on the external wall of the beating element 2 at the operating end 7.

The apparatus 1 of the invention further comprises a multi-die unit 35 which is provided with a plurality of dies or counterpunches 36 that are suitable to cooperate with the respective punching tools 10 for performing cuttings and/or punchings on the workpieces. The multi-die unit 35 is associated with a worktable 13 of the punching machine.

The first driving means 3 comprises a linear actuator that includes, in the embodiment that is shown in the figures, a hydraulic cylinder that is provided with a piston 31, which the beating element 2 is rotatably connected to and which is mobile within a chamber 32 of the upper supporting element 11 that is supplied with pressurized fluid. Anti-rotation means, which is not illustrated, is provided for preventing the piston 31 rotating around the working axis X during operation. The coupling between the piston 31 and beating element 2 is such as to allow the free rotation of the latter around the working axis X.

Alternatively, the first driving means 3 may comprise an electric rotating actuator that is coupled, via transmission elements, to the beating element 2 for linearly moving the latter along the working axis X. The transmission elements comprise, for example, a screw-nut unit of known type.

The first driving means 3 moves the beating element 2 and the punching tool 10 associated thereto along a working stroke having a length, which is unction of the thickness of the workpiece.

Reference means 40 is interposed between the beating element 2 and the piston 31 for elastically and reversibly blocking the beating element 2 to the piston 31 in a predefined initial angular position, so-called zero position of the beating element 2, in order to prevent the free rotation thereof. In the shown embodiment, reference means 40 comprises a spring stop, which is fixed to the piston 31 and acts on an abutment wall of the beating element 2. More precisely, reference means 40 comprises a ball 41 that is pushed by a spring 42 against an abutment wall 43 of the beating element 2 in which a reference seat 44 is carried out. When the ball 41 is engaged in the reference seat 44, a form coupling is carried out that locks the beating element 2 to the piston 31. By exerting on the beating element 2 a rotation torque that is greater than a defined minimum torque, it is possible to disengage the ball 41 from the reference seat 44 and rotate the beating element 2.

The second driving means 4 includes a bushing or ferrule 15 that is rotatably housed in the upper supporting element 11 of the apparatus 1, in particular by bearings 45, so as to rotate around the working axis X driven by a second actuator 33. The bushing 15 comprises a cylindrical element that is provided with an internal through cavity 16 of cylindrical shape that allows the insertion and the passage of the beating element 2, which is free to rotate around the working axis X.

In the illustrated embodiment, the bushing 15 is rotated by the second actuator 33 via transmission means comprising a toothed portion 27, which is carried out on an external cylindrical wall of the bushing 15 and a gear wheel 28, which engages said toothed portion 27 and is rotated by the second actuator 33.

Alternatively, the transmission means may comprise a belt, which is wrapped in a closed loop around a cylindrical portion of the bushing 15 and around a driving pulley that is rotated by the second actuator 33.

The bushing 15 is coupled with the tool holder unit 20 so as to rotate with the latter around the working axis X. For this purpose, the bushing 15 comprises a connection end 15*a* that is provided with third coupling means 17 and the tool holder unit 20 comprises a coupling end 26, which faces the connection end 15*a* and is provided with fourth coupling means 18 that is arranged to couple, in particular in a sliding manner, with the third coupling means 17.

Figure 2:
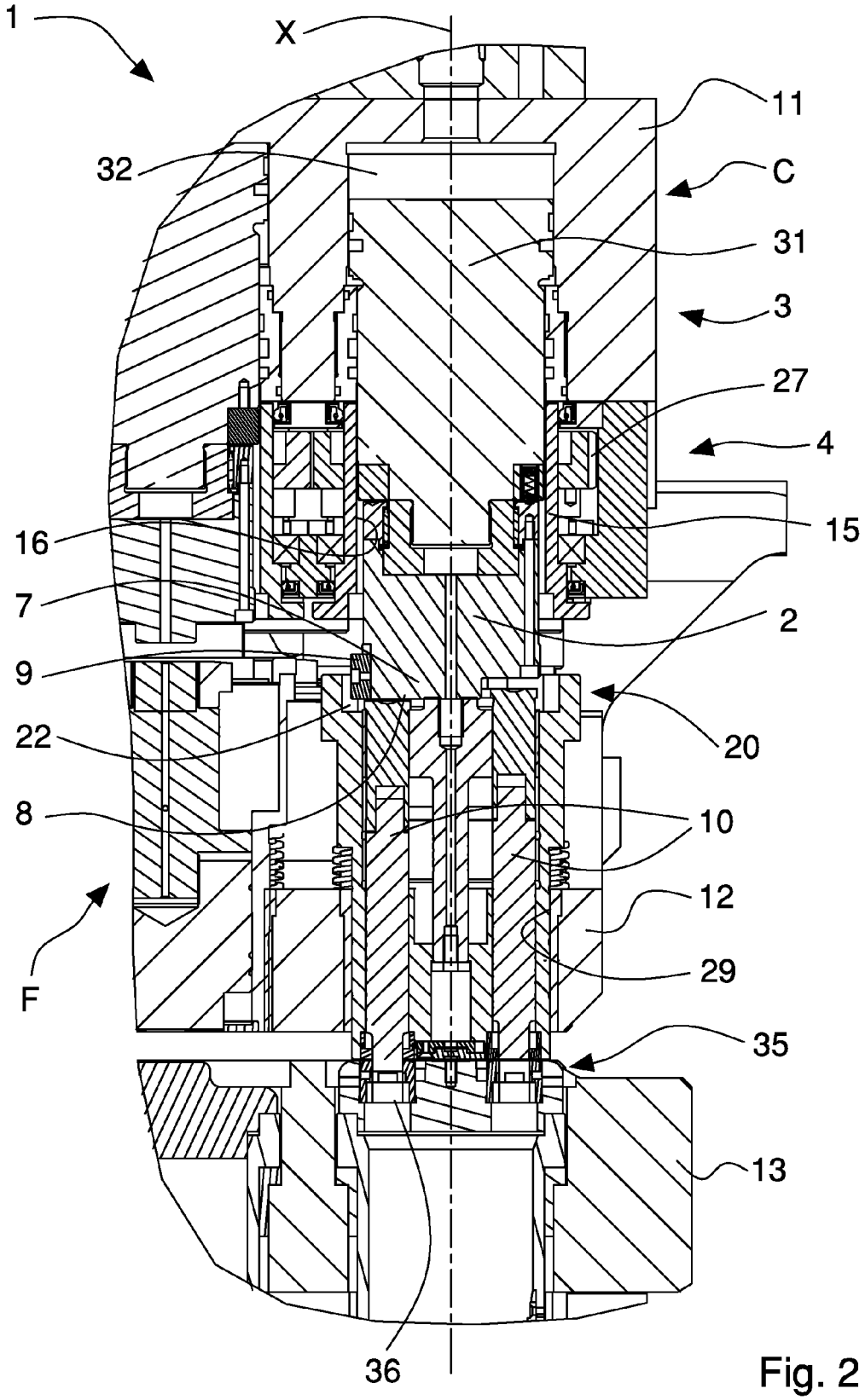
FIG. 2 is a longitudinal section of the apparatus of FIG. 1 wherein the beating element is in an external operating position.
Figure 3:
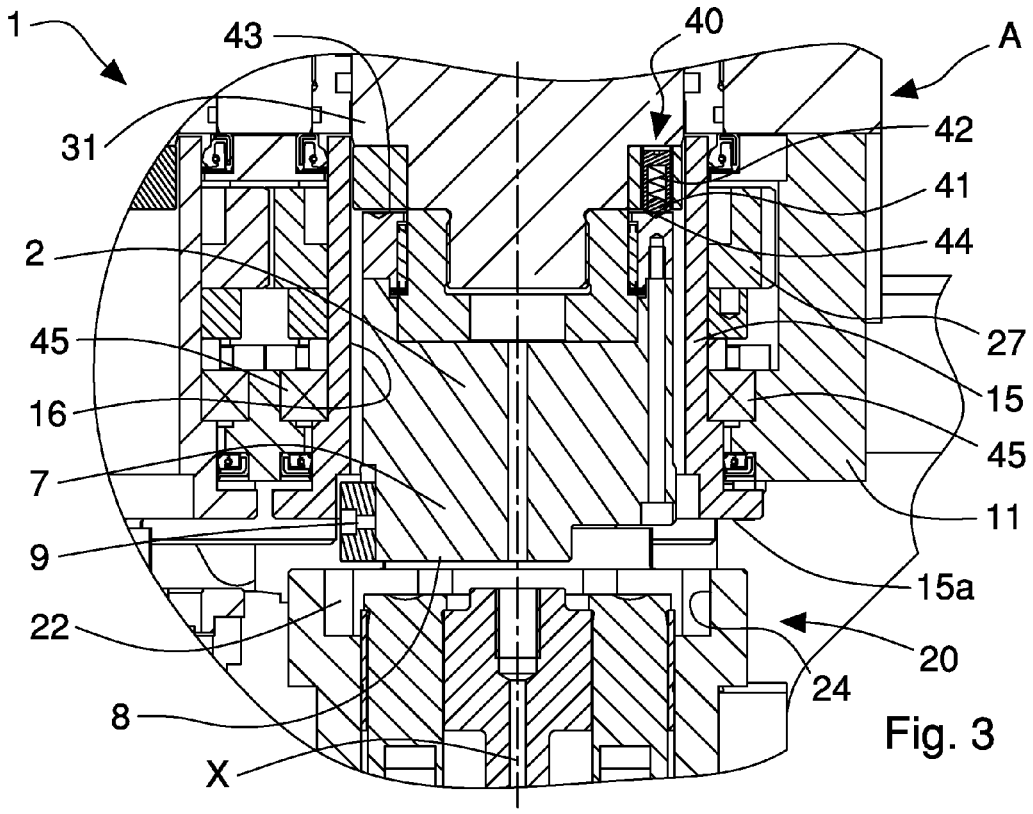
FIG. 3 is an enlarged detail of the apparatus of FIG. 1.
Figure 5:
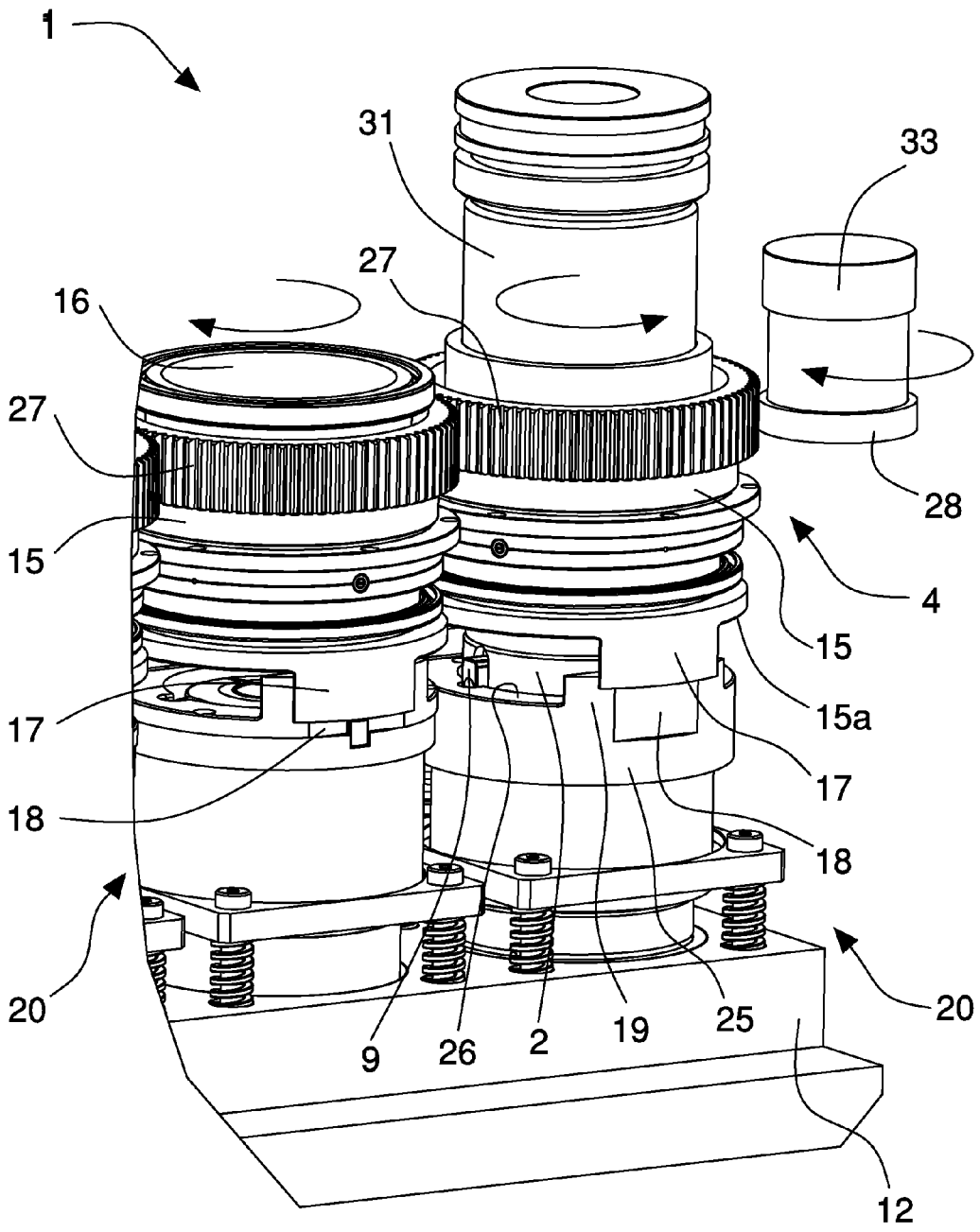
FIG. 5 is a interrupted perspective view of the punching apparatus of FIG. 1 wherein some elements have been removed for better illustrating below elements.
Figure 7:
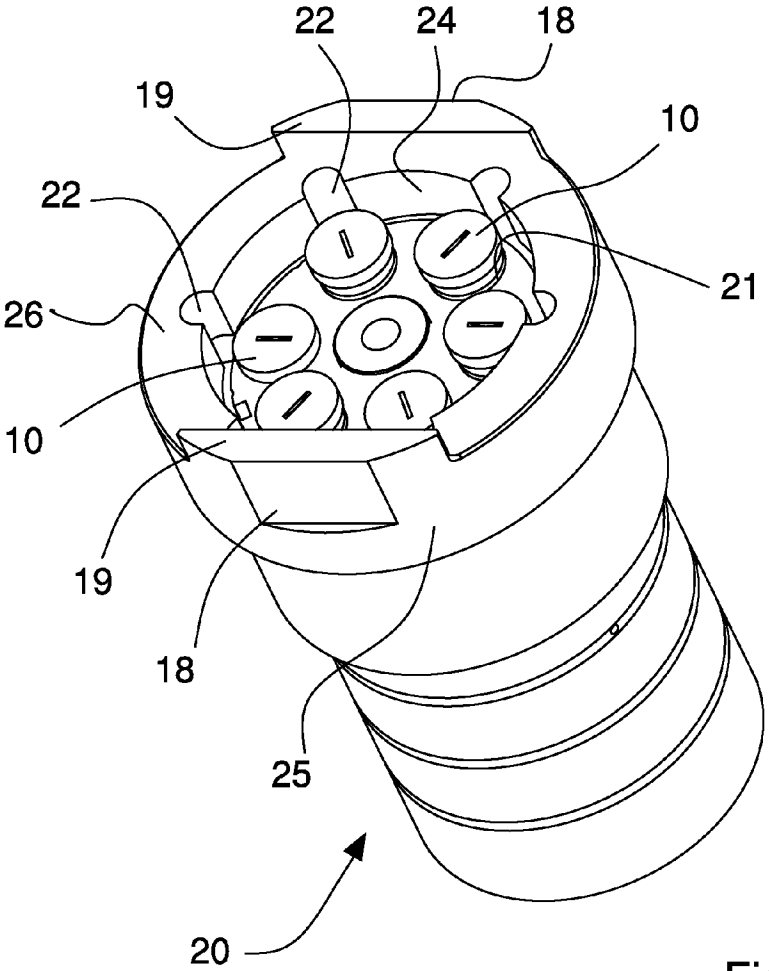
FIG. 7 is a top perspective view of a tool holder unit of the apparatus of FIG. 1.
Figure 6:
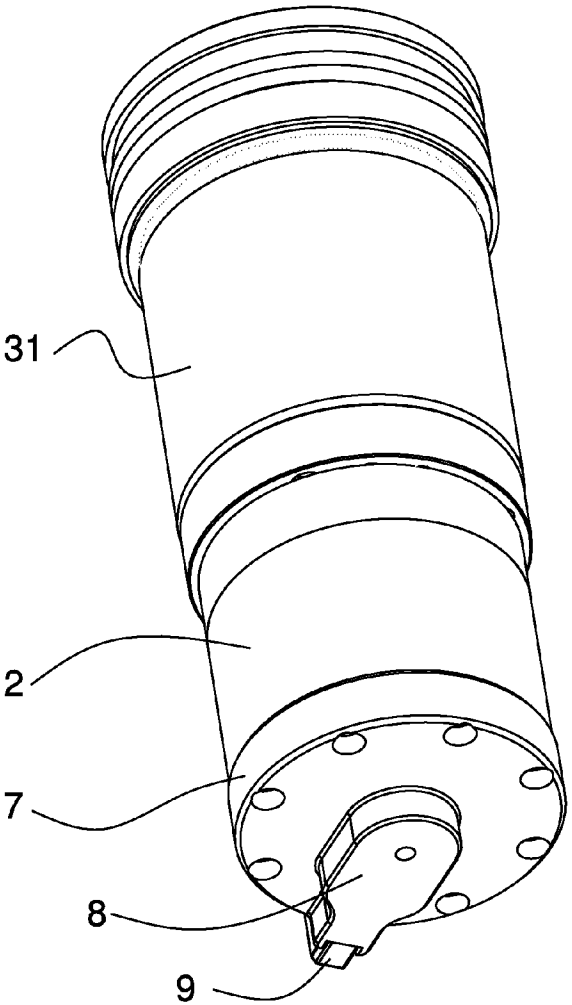
FIG. 6 is a bottom perspective view of the beating element of FIG. 1.

With particular reference to FIG. 5, the third coupling means comprises a couple of protruding elements 17, which extend longitudinally and parallel to the working axis X from the connection end 15*a* and are arranged to engage and couple with respective coupling faces 18 of the fourth coupling means of the tool holder unit 20. Said coupling faces 18, which are mutually parallel and opposed, are carried out on an external cylindrical wall 25 of the tool holder unit 20 and on two respective protrusions 19, which extend longitudinally and parallel to the working axis X from the coupling end 26 of the tool holder unit 20 in the direction of the beating element 2. In this manner, the third coupling means 17 and the fourth coupling means 18 ensure the coupling and therefore the transmission of a rotational torque between the bushing 15 and the tool holder unit 20 even when the latter moves along the working axis X towards the workpiece as a result of the impact of the beating element 2 on the punching tool 10 (FIG. 2).

The tool holder unit 20 is slidably and rotatably housed in a respective housing 29 of the lower supporting element 12 of the punching apparatus 1.

As illustrated in the figures, the punching apparatus 1 preferably comprises a plurality of tool holder units 20 and a plurality of respective beating elements 2 that are arranged for example along one or more parallel rows for performing several operations on the same workpiece and/or more sequential machining operations without the need for replacing the tools, but simply by moving the workpiece and positioning the latter under the appropriate beating element 2. The punching apparatus 1 constitutes a so-called multiple punching head. Each beating element 2 is driven by a respective first actuator 31, 32 of the first driving means 3 so as to selectively interact with a set punching tool 10 of the corresponding tool holder unit 20.

The second driving means 4 comprises a plurality of bushings 15 each of which is coupled with a respective tool holder unit 20 so as to rotate with the latter around respective working axes X.

The bushings 15 are advantageously connected to each other so as to rotate together driven by a single second actuator 33 through suitable transmission means.

In the illustrated embodiment, each bushing 15 comprises a respective toothed portion 27, which is arranged to engage with a toothed portion 27 of an adjacent bushing 15, the second actuator 33 rotating a gear wheel 28 that is engaged with one of said toothed portions 27. The toothed portions 27 of the bushings 15 and the gear wheel 28 form the transmission means.

Alternatively, the transmission means may comprise a belt, which is wrapped in a closed loop around cylindrical portions of the bushings 15 and around a driving pulley that is rotated by the second actuator 33.

In an embodiment that is not illustrated in the figures, it is provided that the punching apparatus 1 of the invention includes a single tool holder unit 20 and single respective beating element 2.

The punching apparatus 1 of the invention also comprises sensors, of known type and not illustrated in the figures, that are arranged to detect the linear position of the beating element 2 (i.e. the operating position thereof) and the rotation of the bushing 15 and therefore of the tool holder unit 10 and the beating element 2 itself in order to control the driving of the second driving means 4 in a step of selection of the punching tool and in a subsequent step of angular orientation (indexing) of the selected punching tool 10, as better explained in the following description.

The operation of the punching apparatus 1 of the invention provides a first step of selection wherein said apparatus 1 is in the selection configuration E, in which the beating element 2 and the tool holder unit 20 are separate and uncoupled and the tool holder unit 20 is rotated around the working axis X by the second driving means 4 by means of the bushing 15 so as to bring a set punching tool 10 at the beating portion 8 of the operating end 7 of the beating element 2. The latter is arranged in the internal operating position A, in which said beating element 2 is spaced apart from the tool holder unit 20 (FIG. 1) and angularly constrained to the piston 31 of the first driving means 3, through the reference means 40, in the initial angular position or "zero position", that is defined and known to a control unit of the punching apparatus 1 or of the machine tool on which the apparatus 1 is mounted. In this manner, the control unit, in cooperation with the sensors, is capable to control precisely the rotation of the tool holder unit 20 that is necessary to select the desired punching tool 10.

Figure 4:
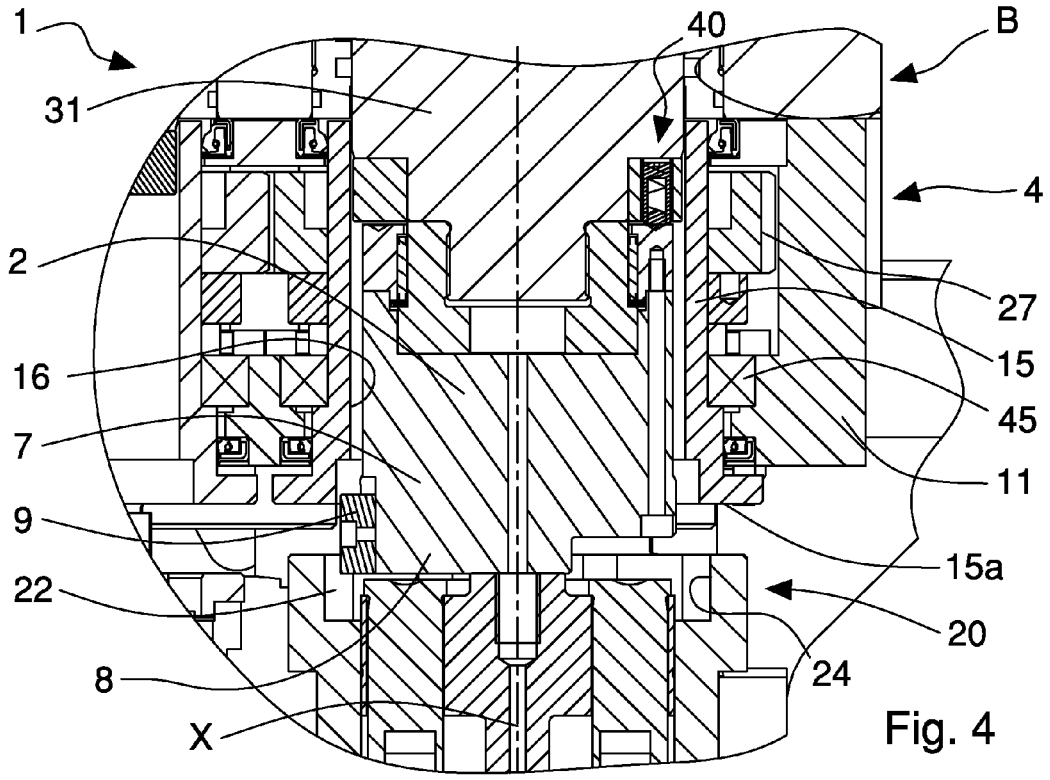
FIG. 4 is an enlarged partial section as the one of FIG. 3 which illustrates the beating element in an intermediate operating position.

In a second step, the beating element 2 is moved by the first driving means 3 in the intermediate operating position B, in which the first coupling element 9 is capable to engage the second coupling element 22 that is associated with the seat 21, which houses the selected punching tool 10 (FIG. 4). In such connection configuration F, the beating element 2 can rotate since is dragged by the tool holder unit 20, so as to rotate the selected punching tool 10 around the working axis X and change the angular orientation (indexing) thereof according to the machining to be performed on the workpiece. The rotation of the beating element 2, which is executed by the second driving means 4 through the bushing 15 and the tool holder unit 20, causes the disengagement of the ball 41 of the reference means 40 from the reference seat 44 of the beating element 2. Once the punching tool 10 is angularly oriented, the beating element 2 is moved by the piston 31 of the first driving means 3 in the external operating position C (FIG. 2) performing a working stroke in which said beating element 2 hits and progressively pushes and moves the punching tool 10 against the workpiece.

When the workpiece machining is completed, the first driving means 3 moves the beating element 2 in the intermediate operating position B, in which the beating element 2 is rotated in the initial angular position by the second driving means 4, through the bushing 15 and the tool holder unit 20. The beating element 2 is then brought back by the first driving means 3 in the internal operating position A, in which the reference means 40 elastically and angularly locks the beating element 2 to the piston 31. In the internal operating position A, the beating element 2 and the tool holder unit 20 are disengaged.

Thanks to the punching apparatus 1 of the invention it is therefore possible to use the same driving means (the second driving means 4) both for selecting a set punching tool 10 of the tool holder unit 20 and for angularly orienting the set punching tool 10 for performing the required machining. In fact, the coupling means 9, 22 enable the operating end 7 of the beating element 2 to be rotated together with the tool holder unit 20, which is rotated by the second actuator 33 of the second driving means 4 through the bushing 15. A single rotating actuator (the second actuator 33) is used for performing two distinct operations that in the known punching apparatuses require two different and separate actuators. Such technical solution allows reducing weight, dimensions and overall cost of the punching apparatus, which is thus particularly compact and with a simplified, more efficient and reliable structure.

The present solution is also particularly advantageous in the case of multiple punching head, that is in the case that the apparatus 1 includes a plurality of tool holder units 20 and respective beating elements 2. In fact, it is possible to use the second actuator 33 for selecting in all the tool holder units 20 (successively and at different times), the required punching tools 10 and for angularly orienting the latter ones, that allowing to considerably simplify the structure of the apparatus, reducing weight, dimensions and overall cost thereof.

The invention claimed is:

1. A punching apparatus comprising:

a tool holder unit rotatable around a working axis and provided with a plurality of seats that are suitable for slidably housing respective punching tools;

a beating element movable along and around the working axis and provided with an operating end that has a beating portion to selectively interact with a set punching tool;

a first driving assembly for moving the beating element along the working axis between an internal operating position, in which the beating element is spaced away from the tool holder unit, an intermediate operating position, in which the beating element is engaged and connected to the tool holder unit, and an external operating position, in which the beating element is engaged by the tool holder unit and abuts and pushes the set punching tool against a workpiece;

a second driving assembly for rotating the tool holder unit around the working axis, wherein the operating end comprises a first coupling element and the tool holder unit comprises a plurality of second coupling elements, each of the second coupling elements being associated with a respective one of the seats and a related one of the punching tools and being arranged to couple with the first coupling element in a connection configuration in which the beating element and the tool holder unit are coupled and rotate together, the second driving assembly in a selection configuration, in which the beating element and the tool holder unit are separate and uncoupled, rotates the tool holder unit for positioning the set punching tool that faces the beating portion of the operating end and for allowing the first coupling element to be coupled with the second coupling element that is associated with the seat of the set punching tool and the second driving assembly in the connection configuration rotates the tool holder unit and the beating element that are mutually connected in order to angularly orient the set punching tool.

2. The punching apparatus according to claim 1, wherein the first coupling element comprises a projecting element fixed to an outer wall of the beating element, the second coupling elements comprise respective grooves located on an internal wall of a housing of the tool holder unit that is suitable for receiving the operating end of the beating element in the connection configuration, and the projecting element is arranged to be inserted in and engage with a set groove.

3. The punching apparatus according to claim 1, further comprising an upper supporting element arranged for housing the first driving assembly and the beating element.

4. The punching apparatus according to claim 1, wherein the first driving assembly comprises a first actuator.

5. The punching apparatus according to claim 4, further comprising an upper supporting element arranged for housing the first driving assembly and the beating element, wherein the first actuator comprises a cylinder provided with a piston, which is rotatably connected to the beating element and slidably movable in a chamber, which is supplied with pressured fluid, of the upper supporting element.

6. The punching apparatus according to claim 5, further comprising a reference arrangement that is interposed between the beating element and the piston in order to lock elastically and reversibly the beating element to the piston in a predefined initial angular position.

7. The punching apparatus according to claim 1, wherein the second driving assembly comprises a bushing provided with an internal through cavity for the beating element and coupled with the tool holder unit so as to rotate with the tool holder unit, and a second actuator connected via a transmission arrangement to the bushing to rotate the bushing and the tool holder unit around the working axis.

8. The punching apparatus according to claim 7, further comprising an upper supporting element arranged for housing the first driving assembly and the beating element, wherein the bushing is rotatably housed in the upper supporting element of the punching apparatus.

9. The punching apparatus according to claim 8, wherein the bushing comprises a connecting end provided with a third coupling arrangement and the tool holder unit comprises a coupling end that faces the connecting end and is provided with a fourth coupling arrangement arranged to couple with the third coupling arrangement.

10. The punching apparatus according to claim 7, wherein the bushing comprises a connecting end provided with a third coupling arrangement and the tool holder unit comprises a coupling end that faces the connecting end and is provided with a fourth coupling arrangement arranged to couple with the third coupling arrangement.

11. The punching apparatus according to claim 1, further comprising a lower supporting element for slidably and rotatably housing the tool holder unit.

12. The punching apparatus according to claim 1, further comprising a plurality of tool holder units and a plurality of respective beating elements to interact with set punching tools of the tool holder units, wherein the beating elements are driven by respective first actuators of the first driving assembly.

13. The punching apparatus according to claim 12, wherein the second driving assembly comprises a plurality of bushings, each of the bushings being coupled with a respective one of the tool holder units so as to rotate with the respective tool holder unit around a respective one of working axes, and the bushings are mutually connected via a transmission arrangement so as to rotate together when actuated by a second actuator of the second driving assembly.

14. The punching apparatus according to claim 13, wherein the transmission arrangement comprises a toothed portion of each of the bushings that is arranged to engage a respective toothed portion of an adjacent one of the bushings, and a gear wheel that engages one of the toothed portions and is rotated by the second actuator.

15. A punching machine tool comprising a punching apparatus according to claim 1.

* * * * *